US008297365B2

(12) United States Patent
Dove

(10) Patent No.: US 8,297,365 B2
(45) Date of Patent: Oct. 30, 2012

(54) DRILLING STRING BACK OFF SUB APPARATUS AND METHOD FOR MAKING AND USING SAME

(75) Inventor: Norval Roland Dove, Houston, TX (US)

(73) Assignee: Vortexx Research, Ltd, Houston, TX (US)

( * ) Notice: Subject to any disclaimer, the term of this patent is extended or adjusted under 35 U.S.C. 154(b) by 275 days.

(21) Appl. No.: 12/227,661

(22) PCT Filed: Jun. 26, 2007

(86) PCT No.: PCT/US2007/014740

§ 371 (c)(1),
(2), (4) Date: Jul. 7, 2009

(87) PCT Pub. No.: WO2008/002534

PCT Pub. Date: Jan. 3, 2009

(65) Prior Publication Data

US 2009/0283322 A1 Nov. 19, 2009

(51) Int. Cl.
*E21B 23/00* (2006.01)

(52) U.S. Cl. ..... 166/377; 175/57; 175/237

(58) Field of Classification Search ..... 166/377, 166/242.6; 175/40, 57, 320, 321, 237; 285/2, 285/3, 4

See application file for complete search history.

(56) References Cited

U.S. PATENT DOCUMENTS

| | | | | |
|---|---|---|---|---|
| 6,186,249 | B1 * | 2/2001 | Bjornstad | 175/320 |
| 6,349,763 | B1 * | 2/2002 | Estep et al. | 166/66.4 |
| 6,598,675 | B2 * | 7/2003 | Bussear et al. | 166/250.15 |
| 2004/0045704 | A1 * | 3/2004 | Bowles | 166/242.7 |

* cited by examiner

*Primary Examiner* — David Andrews
*Assistant Examiner* — Richard Alker
(74) *Attorney, Agent, or Firm* — Robert W. Strozier

(57) ABSTRACT

A back-off sub apparatus is disclosed. The apparatus includes a connection connecting a rotational section and a non-rotational section. The rotational section is designed to be rotated via a ball dropped into the well under sufficient pressure to cause the rotational section to rotate relative to the non-rotational section supplying a controlled and sufficient torque to the connection to break the connection. The connection then is unthreaded by normal surface action. The disconnected or upper section of the apparatus and the drill string section associated with it can be withdrawn from the well leaving the lower portion and the drill string section associated with it in the well.

18 Claims, 12 Drawing Sheets

DRILLING STRING BACK OFF SUB APPARATUS AND METHOD FOR MAKING AND USING SAME

BACKGROUND OF THE INVENTION

1. Field of the Invention

The present invention relates to a back off sub for use in oil and gas drilling.

More particularly, the present invention relates to a back off sub for use in oil and gas drilling including a control section, an intermediate section and an abandonment section, where the intermediate section includes a connection that when broken, separates the abandonment section from the intermediate and control sections.

2. Description of the Related Art

While drilling oil wells, particularly highly deviated wellbores, the drill string can get stuck due to well-bore instability, failure to clean the hole adequately, very permeable low pressure zones, etc. When a drill string gets stuck, much effort is expended in getting it unstuck by pulling, slacking off, torqueing and jarring on it. If these efforts fail to unstick the drill string, it becomes necessary to get the portion of the drill string that is above the stuck point separated or disconnected from the lower, stuck portion of the string.

Current art calls for rigging up a wireline unit, locating the free-point then using an explosive charge in combination with applied left hand torque to cause a threaded "tool joint" to unscrew. Often the first attempt does not successfully cause a tool joint to unscrew and the job must be repeated. If the string does not unscrew after several attempts, a larger explosive charge is run into the string on wire-line that will destroy a tool joint, thus freeing the unstuck portion of the drill string from the stuck portion.

The purpose of the invention disclosed herein is to allow a drilling string used in an oil well to be unscrewed or backed off in the event it becomes stuck while drilling an oil or gas well.

An oil well is drilled with a drill string. A drill string is a length of individual joints of tubing, connected by threaded joints called tool joints. The string extends from the surface to the bottom of the hole where a drill bit is connected to the bottom of the string. Usually, the entire drill string is rotated in a clockwise manner when viewed from the top transmitting torque from the surface to the bit to enable the bit to drill rock at the bottom of the hole. In addition to transmitting torque, the tubes are hollow and fluid called "mud" is pumped down the tubing and out the bit to cool the bit, assist the bit in cutting the rock and to lift the rock cuttings back to the surface. The string has to have enough tensional capacity for the upper portion to support the entire string weight. Torque requirements typically vary from 2,000 ft-lbs to 30,000 ft-lbs. Pressures typically vary from 2,000 psi to 7,500 psi and tension can vary from 50,000 lbs to more than 1,000,000 lbs.

Tool Joint

Tool joints, the threaded connectors that allow the drill string to be connected, generally have a larger outside diameter that the tubes and are typically 1-2 feet long. The female portion of the tool joint is welded to the upper portion of the tube and the male portion of the tool joint is welded to the lower portion of the tube. Drill string tool joints are typically screwed together with very high make-up torque. 6⅝" Full Hole connections can be made up to 56,000 ft-lbs of torque. A similar amount of torque is normally required to unscrew the connection.

Tool joints are designed with metal flats that allow the connection to be preloaded to provide higher strength and stiffness and also to provide a metal to metal hydraulic seal. When a connection is broken, a large amount of torque is required to start the un-screwing rotation but once started, further rotation requires little torque. When the connection is screwed together, very little torque is required until the metal faces come together and then very high torque is required for the last small amount of make-up.

Drill String Composition Including Jars

A drill string is typically made up of 2 sections, the uppermost, extending from the surface to within a few hundred feet of the bottom, is drill pipe. Drill pipe typically has tube OD's of 3½", 4½", 5", 5½", 5⅞" and 6⅝" and are usually 28-30 ft long. Tool joints are welded to both ends of the tube with the upper tool joint having a female threaded connection and the lower tool joint having to male threaded connection. A joint of drill pipe with tool joints is usually around 31 ft long. At the bottom of the string, there is a series of specialty type tubular joints called the BHA. This section of the string usually consists of 2 additional types of tubulars, heavy weight drill pipe and drill collars. A BHA's main purpose is to provide weight to place on the bit and to house electronic downhole instruments. The drill collars typically have the largest outside diameters in the string and the heavyweight drill pipe is made up of tubes similar in OD to the drill pipe but with smaller inside diameters, therefore weighing more than the normal drill pipe. Most drilling BHA's have tools called "jars" in them which can often free a BHA if it becomes stuck. Jars are tools that can induce large impact forces to the string by either pulling or resting large amounts of weight on them. They cause impact by mechanically or hydraulically storing large amounts of tension and/or compression energy and then releasing it suddenly. Jars are normally located in the heavyweight drill pipe but can also be located within the uppermost section of the drill collars.

How a Drill String can Get Stuck

When drilling with a drill string, a new hole is opened up by the bit, allowing the drill string to progress downward. Occasionally, the hole can collapse, usually in a new hole, around the largest components of the BHA, the drill collar, sticking the drill string within the hole. Drill strings can also become differentially stuck which is caused by a hydraulic imbalance between the drill sting and low pressure, permeable sections in the hole. The drill string is stuck if it cannot be removed from the wellbore with normal or even elevated surface tension on the string. Often, the annular area around the drill collars can sometimes collapse enough to block the passage of mud from the bit to the surface. When a sticking event happens, the initial method used to free the string is to attempt to "fire" the jars. If the string is stuck below the jars, they can be fired by alternately pulling large amounts of tension on the string and waiting for the jars to fire upwards or lowering large amounts of weight on jars and allowing them to fire downwards. Operators typically jar on the stuck portion of the string until the drill string is free or until the jars quit working. If the string becomes stuck above the jars, there is no method to free the string from the surface other than pulling, relaxing and twisting.

If the drill string cannot be freed, the drill string must be disconnected above the stuck point.

How Wire-Lines are Used to Free Stuck Drill Strings

Currently, the normal method used to disconnect the unstuck portion of the string from the stuck portion is to use wire-line equipment. As soon as it appears that the string cannot be jarred free, a wire-line "back-off" service company is mobilized to the drill site. Depending on the location of the rig (offshore, on land, in a remote location, etc.), it can take from a few hours to days to mobilize wire-line back-off equipment.

Once the equipment and personnel are at the drill site, the wire-line equipment is rigged up and special tools and explosives are run down the center of the drill string tubes. A back-off explosive is typically made of up to 600 grams of primer cord to back-off a large drill string connection. The special tools can locate tool joints and also contain strain gages that are used to determine where the pipe is free. The wire-line tools are periodically set in the inside of the drill string and the drill string is pulled and twisted. The wire-line tool measures the strain of the drill pipe both in torsion and in tension and can determine if the drill string is free or stuck at the point the measurement is taken. Once the point at which the drill string is stuck is determined, tension in the string is adjusted to allow the point at which the string is to be backed off to be neutral and left hand torque is worked down the drill string from the surface. The amount of left hand torque worked into the string has to be lower than the torque required to unscrew a connection so as not to unscrew the drill string at a point above the desired one. When an adequate amount of torque has been worked into the string, the explosive charge, which has been positioned inside the tool joint that will be unscrewed, is detonated. The detonation acts as a large impactor that allows the joint to unscrew with significantly less left hand torque than would normally be required. Very often, it requires more than one detonation to unscrew the joint. If, after several attempts, the tool joint still does not unscrew, a larger explosive charge is run on wire-line that can cause the female portion of the tool joint to split and enlarge allowing the pipe to become separated without any left hand rotation.

Major Disadvantages

The major disadvantage to the use of wire-line to back-off a stuck drill string is the time required to mobilize, rig up and deploy wire-line tools, equipment and personnel. It often takes 12-24 hours to just be in a position to attempt a back-off. Hole conditions typically deteriorate with time and the point at which the string is stuck can move up rapidly, often sticking even more of the string.

Thus, there is a need in the art for an improved apparatus and method for back-off a struck section of drill string to decrease down time and to facilitate down hole operations.

SUMMARY OF THE INVENTION

The present invention provides a back-off apparatus including an hydraulically activated mechanism for supplying an amount of torque to a standard pipe connection in the back-off apparatus sufficient to break or loosen the connection. Once loosened, a proximal portion of the back-off apparatus and an upper portion of a drill string are disconnected from a distal portion of the back-off apparatus and a lower section of the drill string. In certain embodiments, the lower section of the drill string comprises a portion of drill string that is stuck within the well bore and cannot be retrieved by simply tripping out of the borehole.

The present invention provides a back-off apparatus including a ball activated hydraulic mechanism for supplying of torque to a standard pipe connection in the back-off apparatus sufficient to break or loosen the connection. The ball is designed to fall into a seat within the back-off apparatus. Once in that seat, fluid pressure is increased until the pressure shears a set of shear pins or other retaining device the fails upon the application of a pressure above a shear or failure pressure. The failure of the retaining device, fluid pressure acts on a piston providing either a vertical or rotary force to break the standard pipe connection in the back-off apparatus. Once loosened, a proximal portion of the back-off apparatus and an upper portion of a drill string are disconnected a distal portion of the back-off apparatus and a lower section of the drill string. In certain embodiments, the lower section of the drill string comprises a portion of drill string that is stuck within the well bore and cannot be retrieved by simply tripping out of the borehole. If the apparatus is designed to use vertical force only, then the apparatus includes an moveable section having a distal end having a plurality of teeth. The fluid pressure moves the movable section downward until the teeth contact teeth associated with an abandonment section of the back-off apparatus (i.e., the abandonment section is located on a distal side of the connection in the back-off apparatus). The shape of the two sets of teeth are designs so that once the teeth on the movable section are in contact with the teeth on the abandonment section, additional downward movement of the movable section due to the fluid pressure is converted into rotary motion of the abandonment section. The degree of rotation is only that needed to break the make-up force holding the connect tight. Generally, the amount of rotation is only a fraction of a full turn of the connection depending on the make-up force. The fraction of a turn is between about ⅛ of a turn to about 1 turn. In certain embodiments, the fraction is between about ⅛ of a turn and about ¾ of a turn. In certain embodiments, the fraction is between about ⅛ of a turn and about ½ of a turn. In certain embodiments, the fraction is between about ¼ of a turn and about ¾ of a turn. In certain embodiments, the fraction is between about ¼ of a turn and about ½ of a turn.

The present invention also provides a method for disconnected a drill string at a desired location or locations including the step of running a drill string into a well bore, where the drill string includes one or a plurality of back-off apparatuses of this invention. Each back-off apparatus includes a hydraulically activated connection loosening assembly capable of supplying sufficient torque to a standard pipe connection in the back-off apparatus to loosen the connection so that it can be disconnected by the rotating the upper drill string to disconnect the connection. Once the drill string is run into the well borehole, inserting a ball into an interior of the drill string at the top of the string. The ball is then either pumped to the back-off apparatus or is allowed to fall to the back-off apparatus, depending on whether the well borehole supports fluid circulation. Once the ball is seated in the back-off apparatus, ramping the fluid pressure to a pressure sufficient to activate the hydraulic device, which converts the hydraulic pressure into a torque sufficient to loosen the standard pipe connection in the back-off apparatus. Once the back-off apparatus connection is loosened or broken, an upper portion of the drill string can be separated from a lower portion of the drill string by rotating the upper portion in a untightening direction and tripping the upper portion out of the well. In certain embodiment, the disconnecting steps are in response to a lower portion of the drill string being stuck in the well borehole. After the upper section is removed, the lower section can be fished out of the well by any known or to be invented process for removing stuck sections of drill strings from well boreholes.

BRIEF DESCRIPTION OF THE DRAWINGS

The invention can be better understood with reference to the following detailed description together with the appended illustrative drawings in which like elements are numbered the same:

FIG. 7A shows the back-off sub apparatus before transitional section engagement and FIG. 7B after transitional section engagement;

DETAILED DESCRIPTION OF THE INVENTION

Figure 1A:
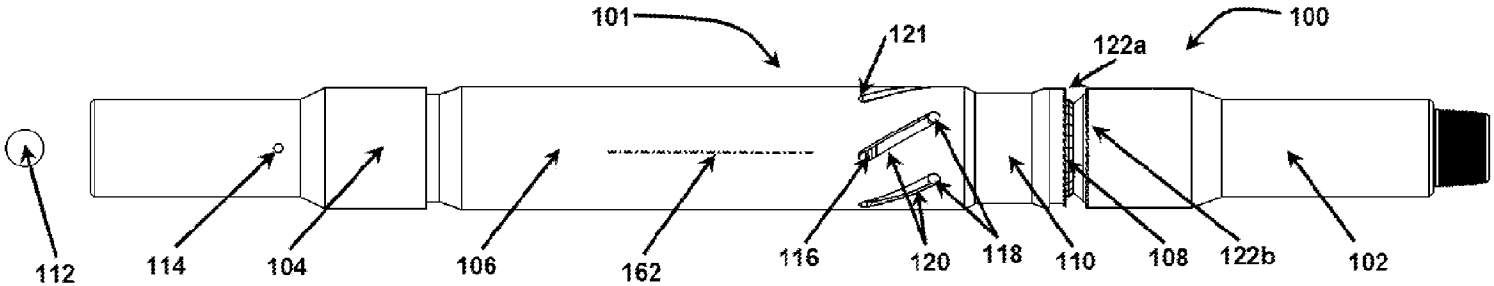
FIGS. 1A-D depict a first embodiment of a back-off sub apparatus of this invention.

The inventors have found that a back-off apparatus or a plurality of back-off apparatuses can be placed in a drill string that allow the drill string to be disconnected at the back-off apparatus, if the drill string becomes stuck in a formation during drilling below the back-off apparatus or the operator desires the ability to disconnect a drill string a one or more locations for other purposes. Drill strings equipped with a plurality of such back-off apparatuses of this invention, where each back-off apparatus is disconnectable independently, permits increased flexibility in the location of disconnection so that the disconnection can be above any portion of the drill string that becomes struck during drilling operations or during other well operations or at a desired locations for other purposes. The back-off apparatuses off this invention allow operators to run with the drill string and to disconnect the drill string at the back-off apparatus almost immediately, if the drill string becomes stuck. Multiple back-off apparatuses can be placed in strategic locations in the drill string and can be selectively and independently activated to disconnect at a most advantageous location or a desired pre-determine location.

In one embodiment, this invention provides for a ball to either fall or be pumped (if circulation is possible) to a back-off apparatus of this invention positioned in the drill string at a desired location in the drill string, where the ball is designed to land in a seat in a movable sleeve of the back-off apparatus. Once the ball is seated, a fluid pressure in the drill string is increased to a predetermined level, a level sufficiently above a standard operating pressure to reduce possible premature activation, causing a plurality of sleeve shear pins to shear. The shearing of the pins or other pressure activated mechanism allows the sleeve to be pushed downward until ports in the sleeve align with conduits hydraulically connecting the fluid within the drill string to a hydraulic cylinder. Pressurizing the cylinder causes a non-rotatable, transition section of the apparatus to be pushed downward until teeth of a distal end of the back-off section engage corresponding teeth on a proximal end of an abandonment section of the back-off apparatus. Continued downward motion of the transition section cause the abandonment section to rotate due to the design of the engaged teeth. In another embodiment, the back-off apparatus includes a rotatable section which has the teeth and the transition section pushes the rotatable section downward until the teeth contact. The fluid pressure then causes the rotatable section to rotate. In either case, once the teeth are engaged, the hydraulic pressure is sufficient to loosen or break the make-up force of the connection in the back-off apparatus, allowing the connection to be unscrewed by simple rotation of the upper section of the drill string.

Since all drill pipe connections rely on a metal to metal seal to contain hydraulic pressure, most of the torque required to make up or break this connection is required to preload the seal. Once the seal is broken, drill pipe connections can be rotated freely to disconnect the connection. The back-off apparatuses or subs of this invention are specifically designed to provide the necessary hydraulically mechanism to break the seal of the connection in the back-off sub. The drill pipe can then be easily rotated to the left to unscrew the connection and the unstuck portion of the string can be removed from the hole.

The present invention broadly relates to a back-off apparatus (back-off sub or sub) for disconnecting a drill string at one or a plurality of locations along a length of the drill string, where the apparatus includes a control section, an intermediate section, an abandonment section and a connection between the control and intermediate sections and the abandonment section, where the apparatus is adapted to disconnect this connection separating the drill string into a retrievable portion and a non-retrievable or stuck portion. The connection of the apparatus is broken by a specially sized ball that is fed into the drill string until it reaches an activation seat within the intermediated section of the apparatus. Upon the application of a sufficient pressure to activate the decoupling mechanism within the apparatus, the connection within the apparatus is broken so that the drill string can be disconnected at the apparatus by simply unthreading the connection from the surface.

To operate a specific back-off sub within a drill string, a steel ball of a diameter specific to that back-off sub is dropped down the inside of the drill string. The ball can fall by gravity or can be pumped to the back-off sub (if circulation is possible), until the ball is seated in a sleeve in the sub. The sleeve is designed to travel downward after a predetermined hydraulic pressure is applied to the ball that shears holding pins or shear pins or other shearing devices in the sub. Once the holding device is sheared by the hydraulic fluid force, the sleeve move downward until ports in the sleeve align with conduits in the sub allowing the fluid to flow into a hydraulic chamber and to act on a hydraulic piston. The piston can include additional shear pins or other pressure sensitive devices that prevent the piston from traveling downward until an activating pressure is attached, which can be a higher pressure than the pressure needed to shear the sleeve shear pins as a further safety mechanism to prevent premature activation. The piston is connected to an external cylinder that has teeth oriented to allow breakout torque to be applied across a full strength tool joint connection located in the back-off sub. Once the devices that prevent premature activation are overcome, the external cylinder is moved downward until the teeth engages teeth in the abandonment section. Further downward motion is converted into rotary motion breaking the make-up force of the connection in the back-off sub.

Alternatively, the sub can include a translational section and a rotatable section. The translational section is designed to push the rotational section downward until teeth in a distal end of the rotational section engage teeth in a proximal end of the abandonment section. Once engage, the rotational section is rotated a sufficient amount by the hydraulic fluid pressure to break the connection.

Holding pin shear strengths and piston areas are designed to prevent premature disengagement of the drill string during normal drilling operations. The disconnection hydraulic pressure is substantially higher than normal drilling pressures to reduce inadvertent disconnection of the drill string at the apparatus. Once the sub joint is "broken", the drill string is rotated to the left to fully disconnect the drill string at the sub. The ball can then be blown through the seat to allow full fluid circulation. The ball can be captured in an upper portion of the back-off tool to insure that it is recovered when the unstuck portion of the drill string is pulled from the well.

Back-off subs (BOSs) of this invention having larger sleeve sizes are located higher in the string, while smaller sleeve sizes are located lower in the string, so that each BOS can be activated independently using different sized balls. For example, if a string includes 3 back-off subs of this invention, one BOS could be located in a drill collar, one just below the jars and one above the jars. The BOSs would be sized so that they could be independently activated using different sized balls. If the jars were not firing, one might drop the middle sized ball to activate the back-off tool just below the jars. If that didn't work due to the string being stuck above that the jar location, the largest ball could be dropped to activate the BOS above the jars.

Once a given BOS is disconnected, the ball would be blown through the seat into a catcher within the upper portion of the BOS, allowing circulation in the hole to be reestablished after BOS disconnection.

Fishing and Safety Joints

Once the free portion of the drill string is separated from the stuck portion, it is often desirable to fish for the stuck portion, which often contains very expensive instruments, drilling hardware and other tools of high value. A fishing string is often used what it called a safety joint that will allow the drill string above the fishing tools to be disconnected if the string becomes stuck after attaching to the "fish".

This invention could be built to fit in any size drill string or bottom-hole assembly (BHA). The pressure at which the BOSs of this invention would actually disconnect the drill string after the ball is dropped would be fully adjustable prior to placing the BOSs in the string. On most deepwater operations, for example, pump pressures used while drilling are around 5000 psi. To provide for an adequate safety margin between BOS activation pressure and drilling pressure, the BOSs are designed to be activated with pressures at or above 7500 psi, which results in the shearing of shear pins that prevent the connection within the BOS from disconnecting during drilling. Thus, the BOSs of this invention can be tuned to a given activation pressure by simply changing the shear pins within the BOS during insertion into a drilling string.

The method for disconnecting a stuck drill string including one or a plurality of BOSs of this invention in a deepwater drilling application includes the step of disconnecting the drill string at the surface of the stuck string and dropping a special ball into the string, where the ball is designed to activate a desired BOS. The method also includes the step of reconnecting the drill string at the surface. If circulation is possible, then the ball is pumped down the string until it is seated in the shear sleeve of its BOS. If circulation is not possible, then sufficient time is allowed for the ball to fall to the BOS and be seated in the shear sleeve of its BOS. Once the ball reaches the shear sleeve and is seated within the sleeve, the fluid pressure is increased to a pressure required to shear the shear sleeve shear pins, where the shearing pressure is sufficient higher than the drilling pressure to reduce or substantially eliminate inadvertent BOS disconnection, e.g., if the drilling pressure is 5000 psi, then the BOS disconnection pressure should be about 50% higher or about 7500 psi or higher. When the shear pins shear, the shear sleeve travels downward and exposes passages from an interior of the drill string to a piston end of a drive cylinder. Once the shear sleeve shear pins shear, which is evidence by a reduction in surface pressure, pumping is continued slowly until the drive cylinder shear pins shear. The pressure to shear the drive cylinder shear pins is greater than the pressure needed to shear the shear sleeve shear pins by about 5 to 20%, e.g., if the shear sleeve shear pins are designed to shear at 7500, then the drive cylinder shear pins are designed to shear at about 8000 psi. When both sets of shear pins have sheared, pumping is continued to a pressure up to about 8000 psi to fully extend the drive cylinder and break the connection in the BOS. The BOS is designed so that only a small volume is necessary to break the connection. Once the drive cylinder is fully extended and the connection broken, the pressure at the surface is released. This pressure reduction allows the cylinder to retract providing a clear path for the upper portion of the BOS to be rotated in a counterclockwise manner to fully disconnect the drill string at the BOS. At this point, it will be desired to circulate. In order to do this, the ball must be blown from the shear seat. By pressuring up to 10,000 psi (an adjustable value, set to 10,000 psi for this example), the ball will blow out of the sleeve and be caught in the ball trap (Item 7) at the base of the upper portion of the tool. The unstuck portion of the drill string can now be withdrawn from the well and either additional jarring or fishing tools run that can easily engage and disengage from the stuck portion of the drill string. Of course, the possibility exists to just withdraw the free portion of the drill string and cement the stuck portion. The sequence of dropping the ball and forcing the shear sleeve downward could be replaced with an electronic valve in the future. Drill pipe with electronic signaling capability is just now coming on the market that could allow the back off tool to be addressed as simply as turning on a light in your house. Acoustic signal actuated devices could also be built.

DETAILED DESCRIPTION OF THE FIGURES

Referring now to FIG. 1A, a plan view of an embodiment of a back-off sub (BOS) apparatus of this invention, generally 100, is shown with its downhole direction to the right. The BOS apparatus 100 includes an abandonment sub section 102. The abandonment sub section 102 is connected to a lower section of the drill string (not shown). The lower section of the drill string is the portion of the drill string that is stuck or is connected to the abandonment sub section 102. The abandonment sub section 102 of the BOS apparatus 100 is adapted to be left in the well when the connection in the BOS apparatus 100 is broken as described herein. The BOS apparatus 100 also includes a control sub section 104 connected to an upper portion of the drill string (not shown). The BOS apparatus 100 also includes a first intermediate section or translational cylinder 106, a threaded connection 108 joining the control sub section 104 to the abandonment sub section 102. The BOS apparatus 100 also includes a second intermediate second or rotational toothed cylinder 110 disposed at a distal end 107 of the translational cylinder 106. The purpose of the BOS apparatus 100, in operation, is to break the make-up-torque associated with the threaded connection 108 of the BOS apparatus 100 without the delay and difficulty associated with breaking a connection above a stuck section using the traditional procedure described in the background section of this application. The connection 108 is broken by rotating the abandonment sub section 102 relative to an upper portion 101 of the apparatus 100 under controlled conditions. The upper portion 101 includes the control section 104, the translational section 106 and the rotational section 110. After the connection 108 is broken, the control section 104 can be rotated at the surface fully unscrewing the connection 108 leaving the abandonment sub section 102 and everything connected thereto in the well. The control sub section 104, the intermediate portions 106 and 110 of the BOS apparatus 100, the upper portion 101, and the drill string upstream of them are designed to be removed from the well after the BOS apparatus 100 is disconnected at the connection 108.

The outer cylindrical translational component 106 is concentric with the inner thin cylindrical rotational component 110 that is adapted to rotate relative to the control sub section 104 and the outer cylindrical translation component or slider 106. The inner rotational cylinder 110 is supported in the distal end 106*a* of the translational sub section 106. The rotational cylinder 110 allows torque to be applied across the threaded connection 108 to disconnect the BOS apparatus 100 at the abandonment sub section 102.

The BOS apparatus 100 also includes guide lugs or pins 118 connected to or affixed to the rotational component 110 disposed within slots 120 in the translational component 106 so that the inner rotational cylinder 110 can rotate the abandonment sub section 102 with sufficient controlled torque to "break" (loosen) the threaded connection 108 between the abandonment sub section 102 and the upper portion 101 of the BOS apparatus 100. The slots 120 in the slider component 106 are inclined relative to a central axis 162 of the BOS apparatus 100. The guide pins 118 are connected rigidly to the inner rotational cylinder component 110.

The rotational cylinder 110 includes a toothed distal end 122*a* and the abandonment sub section 102 include a toothed proximal end 122*b*. These two toothed ends 122*a* and 122*b* are designed to matingly engage so that the teeth of 122*a* are inclined in a direction opposite to a direction of inclination of the teeth 122*b*. Thus, when the rotational section 110 is rotated, the rotation breaks a make-up force of the connection 108.

The outer cylindrical transitional component 106 is adapted to undergo an axial translation toward a bottom of the well that causes the translational component 106 and the rotational component 110 to move downward until the two toothed ends 122*a* and 122*b* matingly engage. Once the toothed end 122*a* and 122*b* are engaged, the translation motion of the translational component 106 causes the pins 118 to travel along the slots 120 rotating the inner rotational component 110 in a controlled manner to break the connection 108. Thus, the inner cylinder component 110 is adapted to first translate the toothed end 122*a* until it engages the toothed end 122*b*. Once engaged or mated, the inner cylinder component 110 is rotated as the pins 118 traverse the slots 120 breaking the connection 108, which can then be fully disconnected by simply rotating the upper drill string section relative to the abandonment section 102 and its connected lower section of the drill string. Just visible in the slots 120 is a restorative mechanism or spring 116, which is described more fully below.

Beside using the BOS apparatus 100 of this invention to disconnect a drill string above a stuck section, the BOS apparatus 100 of this invention can also be positioned a desired points of disconnection along the drill string for the insertion of specialized equipment into the drill string during drilling operations. For example, a BOS apparatus 100 of this invention can be positioned to allow easy installation of a whipstock or other down-hole tool at an upper end of the abandonment sub 102. Moreover, a plurality of BOS apparatuses 100 of this invention can be positioned at desired locations along the drill string to allow flexibility in drill string disconnections. This flexibility can be used to insure that the portion of the drill string left behind will be as small as practical without causing any damage to drill string section due to the use of explosive charges. This flexibility also allows placement of BOS apparatuses 100 of this invention as desired positions along the drill string that can be easy, quickly and efficiently disconnected to insert a tool or other specialized equipment into the drill string in a controlled manner during drilling, completion or other operations.

Figure 1B:
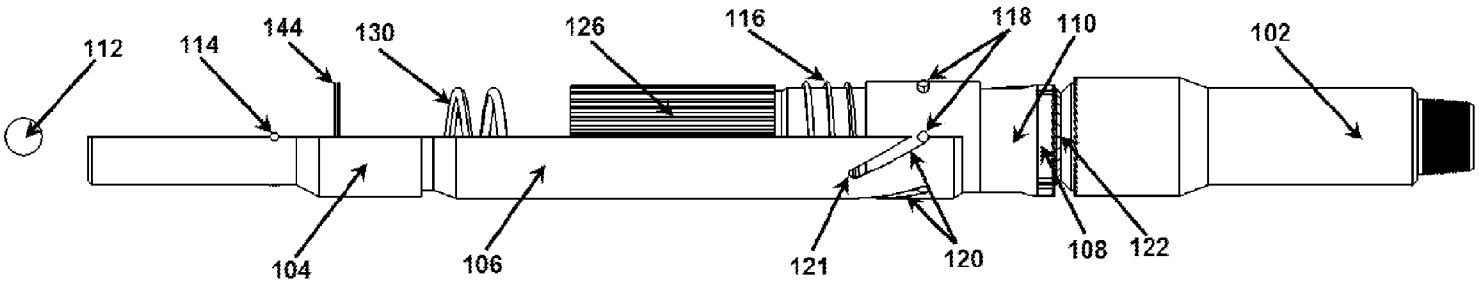

Referring now to FIG. 1B, the BOS apparatus 100 of FIG. 1A is shown in a partial cut away view showing in greater detail most of the upper components of the BOS apparatus 100 that will be removed from the well when the connection 108 of the BOS apparatus 100 is disconnected. Evident in FIG. 1C are two restoring mechanisms 116 associated with the rotational component 110 and 130 associated with the translational section 106, which are more fully described below.

Figure 1C:
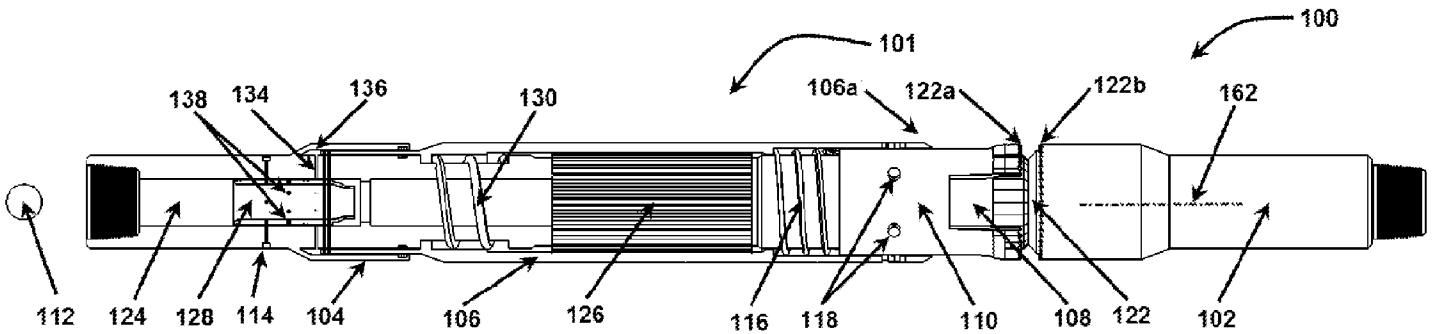

Referring now to FIG. 1C, shows an additional 90° rotation of FIG. 1B to better see other components of the apparatus 100. It is common in the state-of-the-art to have a drop ball 112 which can be dropped down a center flow passage 124 with the fluid to be caught in a catching device 128. Such balls 112 and catchers 128 come in various mating sizes to allow multiple BOS units to be installed in a single long drill string. Each BOS 100 is designed to catch a ball 112 of smaller diameter than the BOS apparatus disposed in the string above a given BOS apparatus 100. Before a particular BOS apparatus 100 is activated the catcher 128 is held in place by a plurality of shear pins 114. The catcher 128 has a plurality of flow ports 138 disposed around a circumference that are hydraulically isolated, by O rings 142 (see FIGS. 2A&B and 6A&B) before a ball 112 is caught. The BOS apparatus 100 is activated by catching ball 112 in catcher 128. Once the ball 112 is catch and seated in the catcher 128, a hydraulic pressure of the fluid in the entire 124 of the drill string and control section 104 is increased until a sufficient force is achieved to fail or shear the upper shear pin set 114, and to move the catcher 128 downward. The catcher 128 is adapted to travel downward until catcher ports 138 disposed circumferentially around the catcher 128 align with a corresponding set of fluid feed conduits tubes 134. The conduits 134 connect the entire 124 with an axisymmetric chamber 136 so that the chamber 136 is filed with the high pressure fluid. One of ordinary skill in the art will note that catcher ports 138 are optional, and the fluid feed tubes 134 can simply be uncovered by the translation of the catcher 128.

Figure 1D:
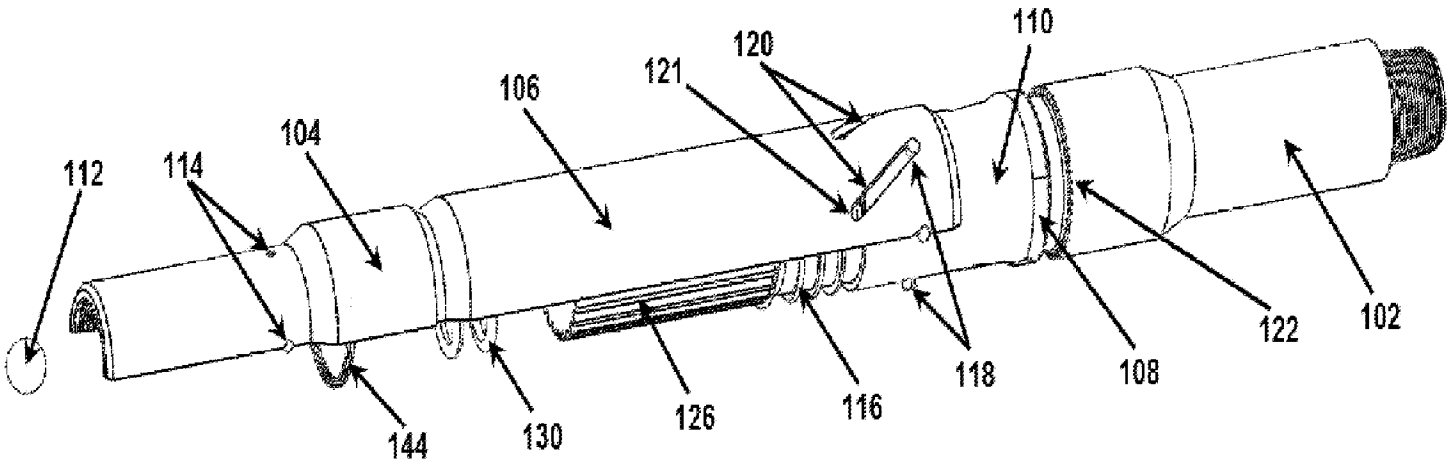

Referring now to FIG. 1D, is a perspective view of the BOS apparatus 100.

Figure 2A:
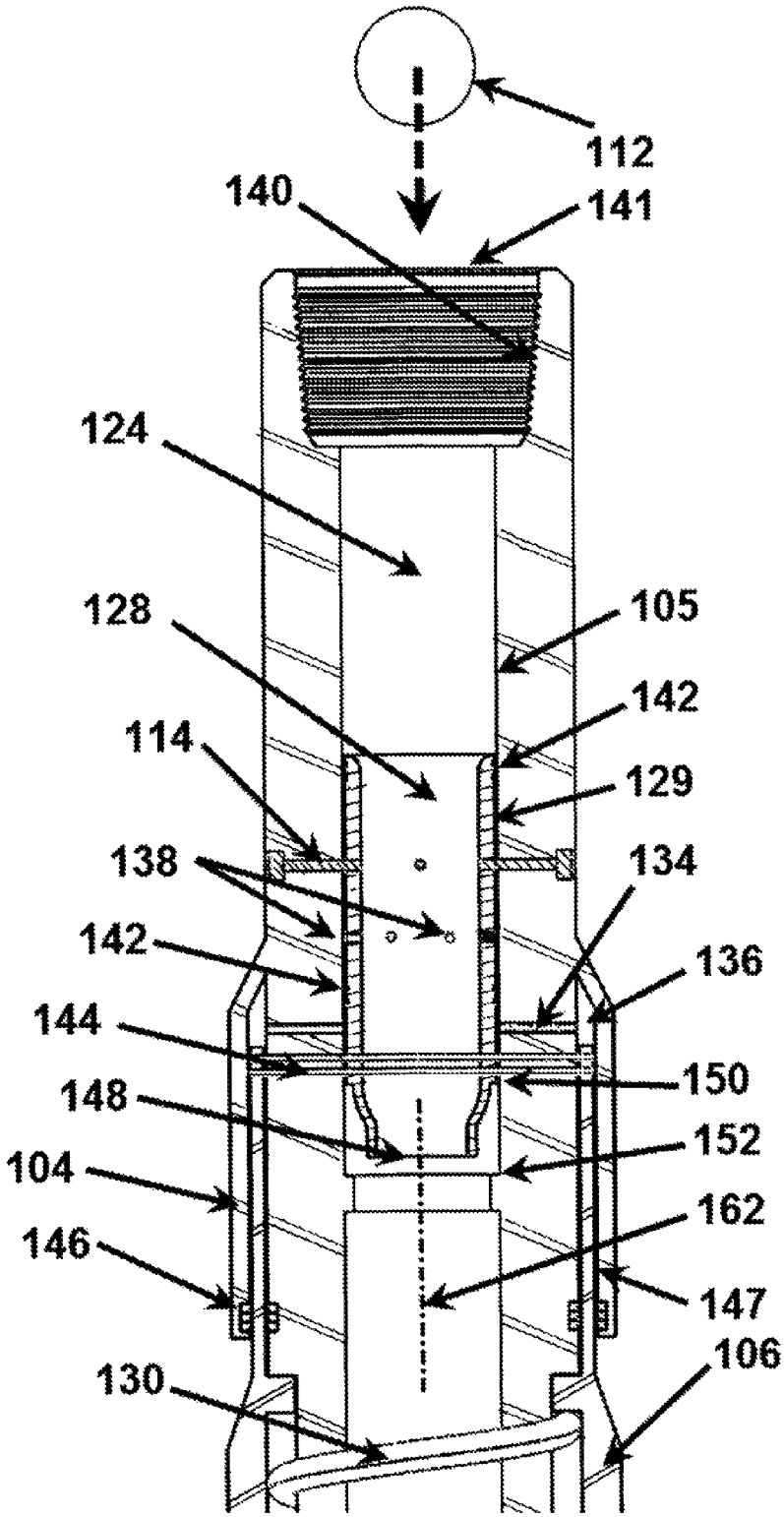
FIGS. 2A&B depicts expanded views of the control section of the apparatus of FIGS. 1A-D.
Figure 2B:
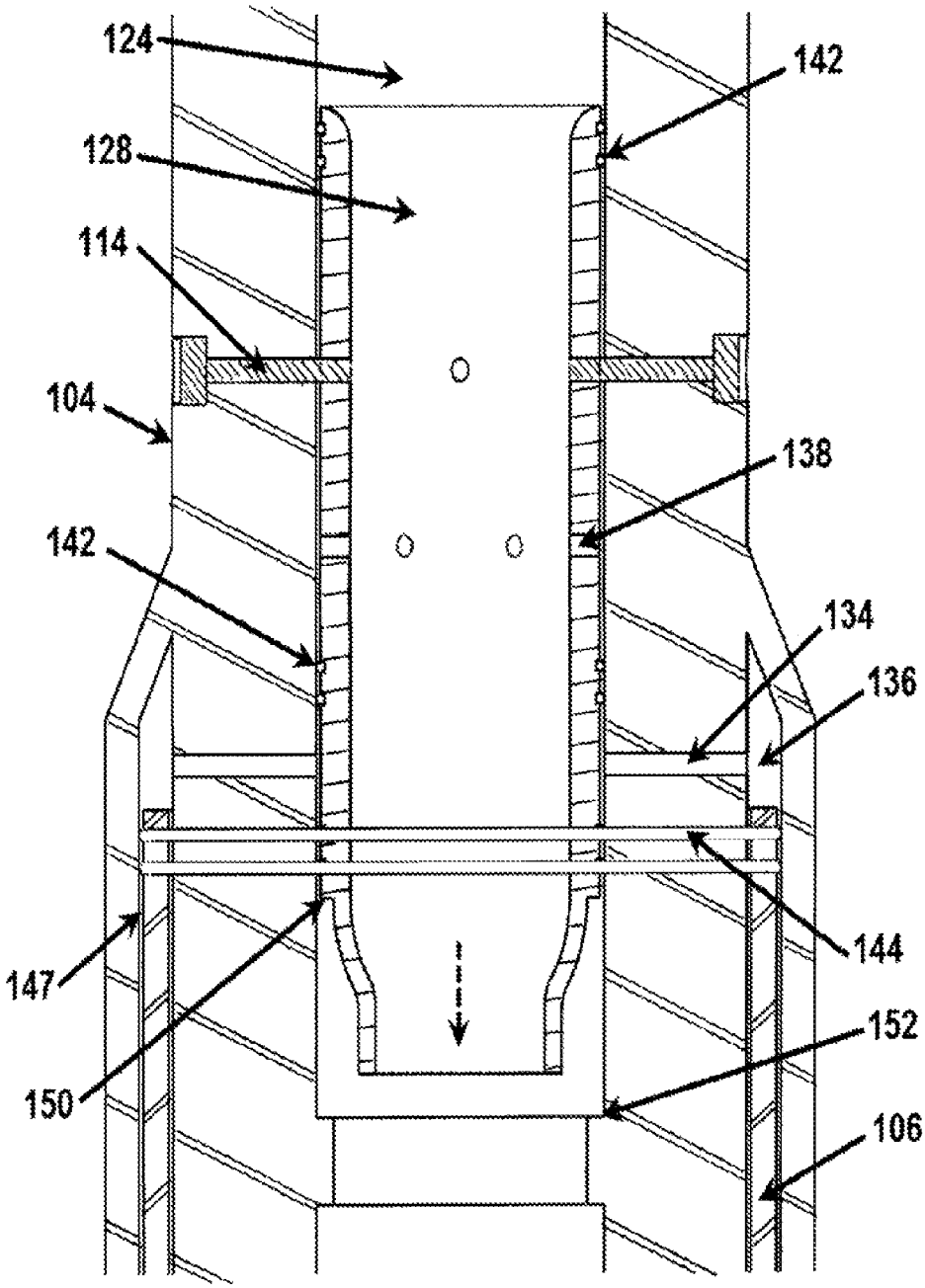

Referring now to FIGS. 2A&B, expanded views of the control section 104 and an upper part of the translational section 106 are shown with the catcher 128 disposed before it catches a correspondingly sized ball 112 with arrows showing what happens when the ball 112 is caught. The control section 104 includes an API female connection 140 disposed in its proximal end 141. The catcher 128 is held in place by the shear pins 114 and sealed from fluid flow between an outer surface 129 of the catcher 128 and an inner wall 105 of the control section 104 adjacent the catcher 128 by O-rings 142.

The control section 104 also includes O rings 144 adapted to seal a region below the chamber 136. Likewise, larger external seals 146 keep out the circulating mud in the surrounding annulus 147. A diameter of a neck 148 of the catcher 128 is designed to stop a specific sized ball, while letting smaller sizes balls pass through. When the proper sized ball has been caught, the bottom shoulder 150 of the catcher 128 will be displaced under pressure until it reaches the top shoulder 152 of the control sub section 104. At that position, the catcher ports 138 align with the controller conduits, ports or tubes 134 connecting the interior 124 and the chamber 136 and fluid can flow from the interior 124 through the tubes 134 into the chamber 136 and filling it.

Figure 3:
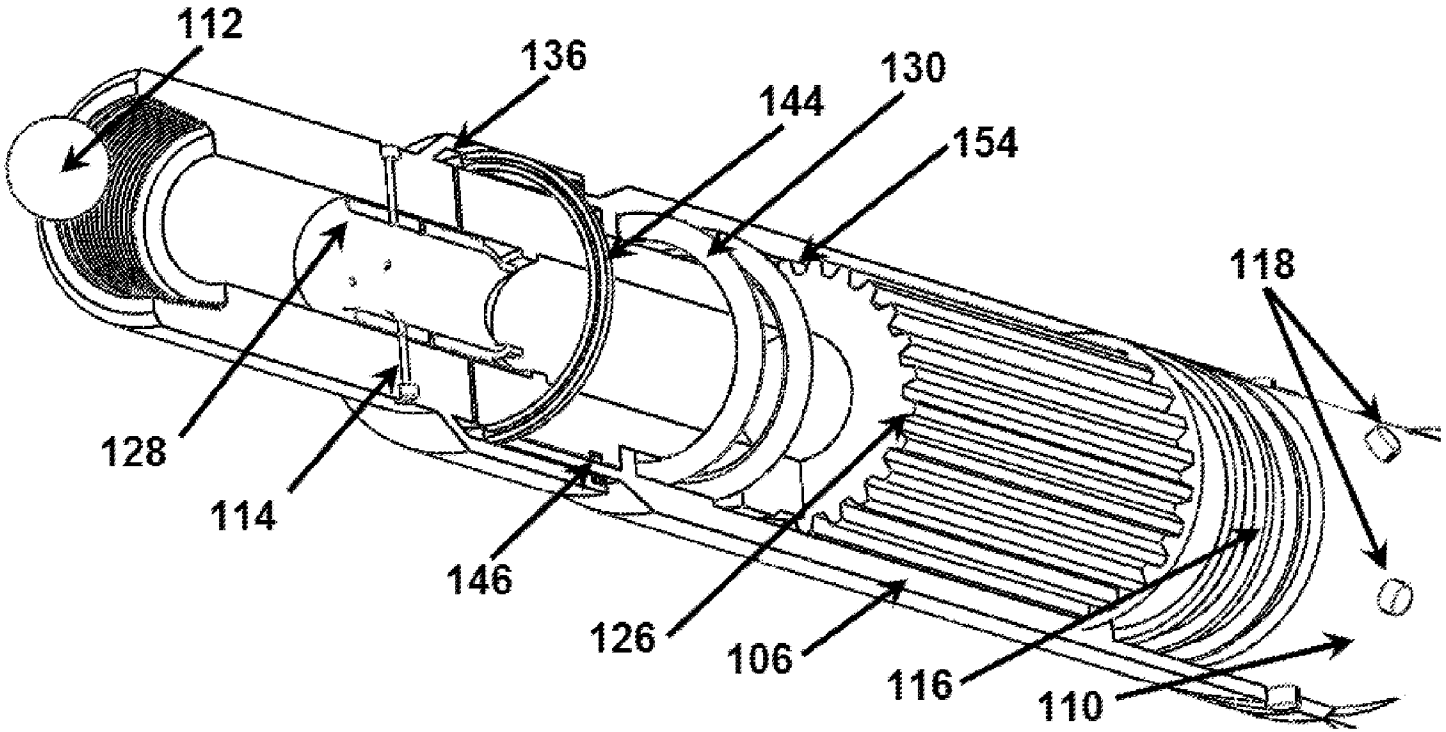
FIG. 3 depicts an expanded view of the upper part of the translational section of the apparatus of FIGS. 1A-D.

Referring now to FIG. 3, shows a partial cut away view of the ribbed (or tongue) region 126 of the control sub section 104 and it's mating with a grooved section 154 of the thin slotted cylinder 106. The arrow show the direction the cylinder 106 moves when the hydraulic fluid pushes against the top of the translational section 106. That mating allows outer thin cylinder 106 to translate relative to the control sub section 104, but does not allow relative rotation between them (the control section 104 and the translational section 106), while the intermediate thin rotational cylinder 110 is designed to rotate relative to control sub section 104. A spring 130 of other restoring means holds the slider component 106 in contact with control sub section 104 until a proper sized ball is caught and sufficient pressure has been applied against the ball to shear the pins 114 and move the catcher 128 to allow fluid pressure to enter the chamber 136 which pushes the translational component 106 and the rotational component 110 downward. A second spring 116 or other restoring means keeps the lugs 118 at the bottom of their respective slots 120 until the BOS apparatus 100 is activated—catching a ball, increase fluid pressure to shear the pins 114 and 158 and move the translational section 106 and the rotational 110 downward until the teeth 122*a* and 122*b* engage followed by rotation of 110 to break the connection 108.

Figure 4:
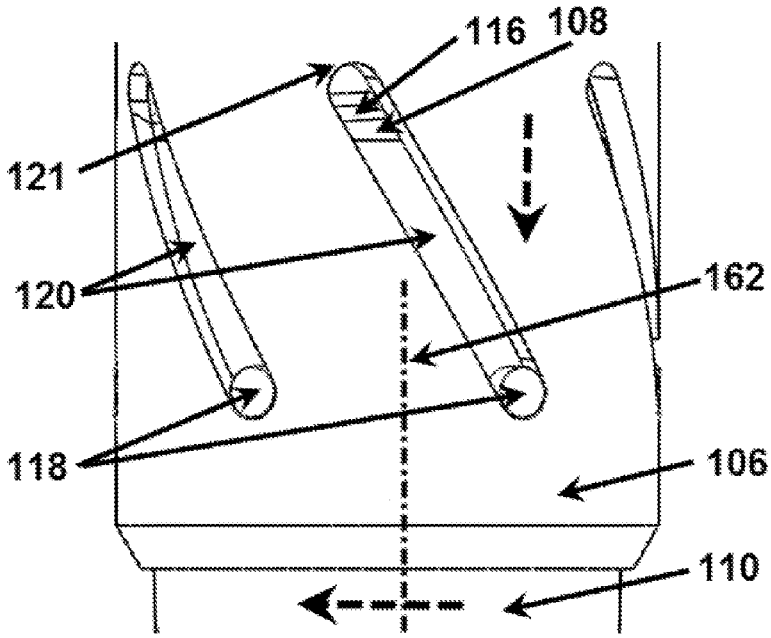
FIG. 4 depicts an expanded view of the lower part of the transilational section and the rotational section of the apparatus of FIGS. 1A-D.

Referring now to FIG. 4, shows more details of the slots 120 of the slider 106, and their interaction with the lugs 118 which moves with intermediate cylinder 110. The spring 116 surrounds the control sub section 104 near its toothed distal end 122*a*. The spring 116 keeps the lugs 118 at the bottom of their corresponding slots 120, as the translational component 106 is translated toward the rotational component 110 by the hydraulic pressure, until the tooth distal end 122*a* of the rotational section 110 engages the toothed proximal end 122*b* of the abandonment sub section 102. After the saw teeth mate, the cylinder 110 stops its axial translation relative to the control section 102. After mating of the toothed ends 122*a* and 122*b*, the hydraulic pressure continues to the translate slider 106 and the lugs 118 travel along their corresponding slots 120 axially downward. The kinematics of the sloped slots 120 cause their corresponding lugs 118 to continue to travel along the slots 120 rotating the control sub section 104 about the axis 162 of the BOS apparatus 100 at the inner cylinder component 110 now mated to the proximal end 122*b* of the abandonment sub section 102. The direction of rotation of the abandonment sub section 102, relative to the distal end 122*a* of the control sub section 104, breaks (releases) the threaded connection 108 between them. Then, the control sub section 104 can be freely rotated by normal surface operation to fully disconnect the threaded connection 108 allowing all other components of the BOS apparatus 100 and the drill string attached thereto to be removed from the well.

In other words, when the ball is caught, the slotted slide 106 is actuated to undergo translation in the downhole direction. The spring 116 initially causes the lug 118 bonded to toothed cylinder 110 to remain in the bottom of the their corresponding slots 120, and therefore also move axially until it is stopped by mating of saw teeth pair 122*a* and 122*b*. After the axial motion of thin cylinder 110 is stopped by mating with the abandonment sub section 102, the inclined slots 120 causes the lugs or guides 118 to move relative to the control sub section 104 (rotate about the common long axis 162 of the sub section 104 and the slider 106) as the slotted slider 106 continues to translate downhole due to the fluid flowing into the chamber 136 pushing the translational and rotational sections downward 106 and 110, respectively.

Figure 5:
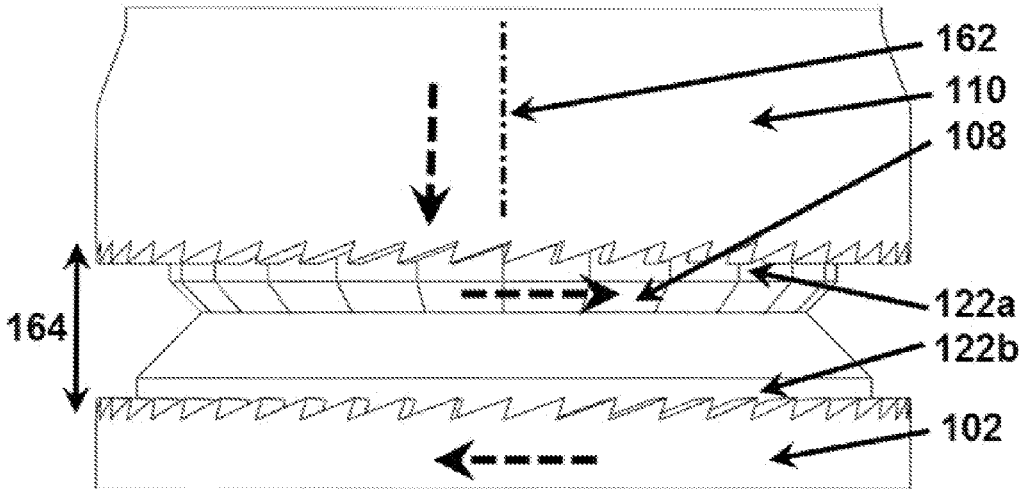
FIG. 5 depicts an expanded view of the toothed distal end of the rotational section and the toothed proximal end of the abandonment section.

Referring now to FIG. 5, shows a close up view of the interaction of the threaded connection 108 between the distal end 122*a* of the controller sub section 104 and the abandonment sub section 102 just before the thin rotational cylinder 110 engages the mating of the pair of saw teeth 122*a* and 122*b*. When the vertical gap 164 has been closed, then the slot-lug interaction causes rotational motion of mated the abandonment sub section 102 and the thin cylinder 110, relative to distal end 122*a* of control sub section 104 (horizontal arrows), so as to break loose the threaded connection 108 between the control sub section 104 and the abandonment sub section 102. Optionally, the initial small gap 164 between the saw tooth set 122*a* and 122*b* can be surrounded by a thin protective cylindrical band (not shown). The band would overlap a portion of the abandonment sub section 102 and the rotational component 110 of the control sub section 104 to simply prevent mud or drilling debris from accumulating in the gap 164 possibly interfering with the necessary mating of the saw teeth.

The circumferential component of the force between the lugs 118 and the slots 120, combined with its radial position, applies a loosening torque about the common center axis 162 of the abandonment sub section 102 and the controller sub section 104. The pressure in the chamber 136 and this loosening torque increase in direct proportion at this stage of the BOS operation. The torque applied across the threaded joint between the abandonment sub section 102 and the controller sub section 104 soon reaches the value required to break the connection 108 between the abandonment sub section 102 and the controller sub section 104. Next, a small relative rotation, in the loosening direction, takes place until the lugs 118 reaches tops 121 of the slots 120.

Figure 6A:
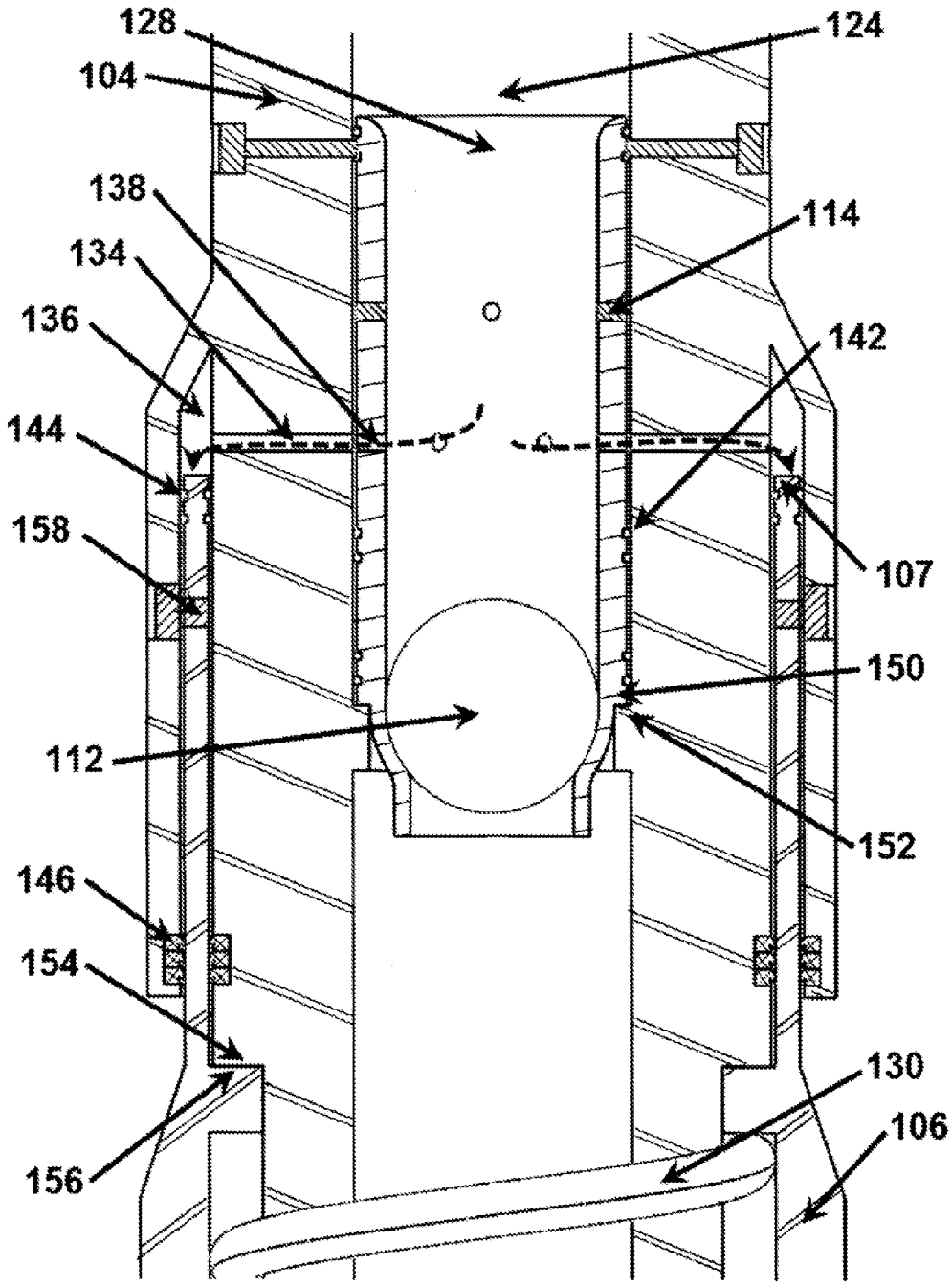
FIGS. 6A&B depict expanded views of the upper part of the sub showing the activation of the sub when a ball seats in the catcher of the apparatus of FIGS. 1A-D.
Figure 6B:
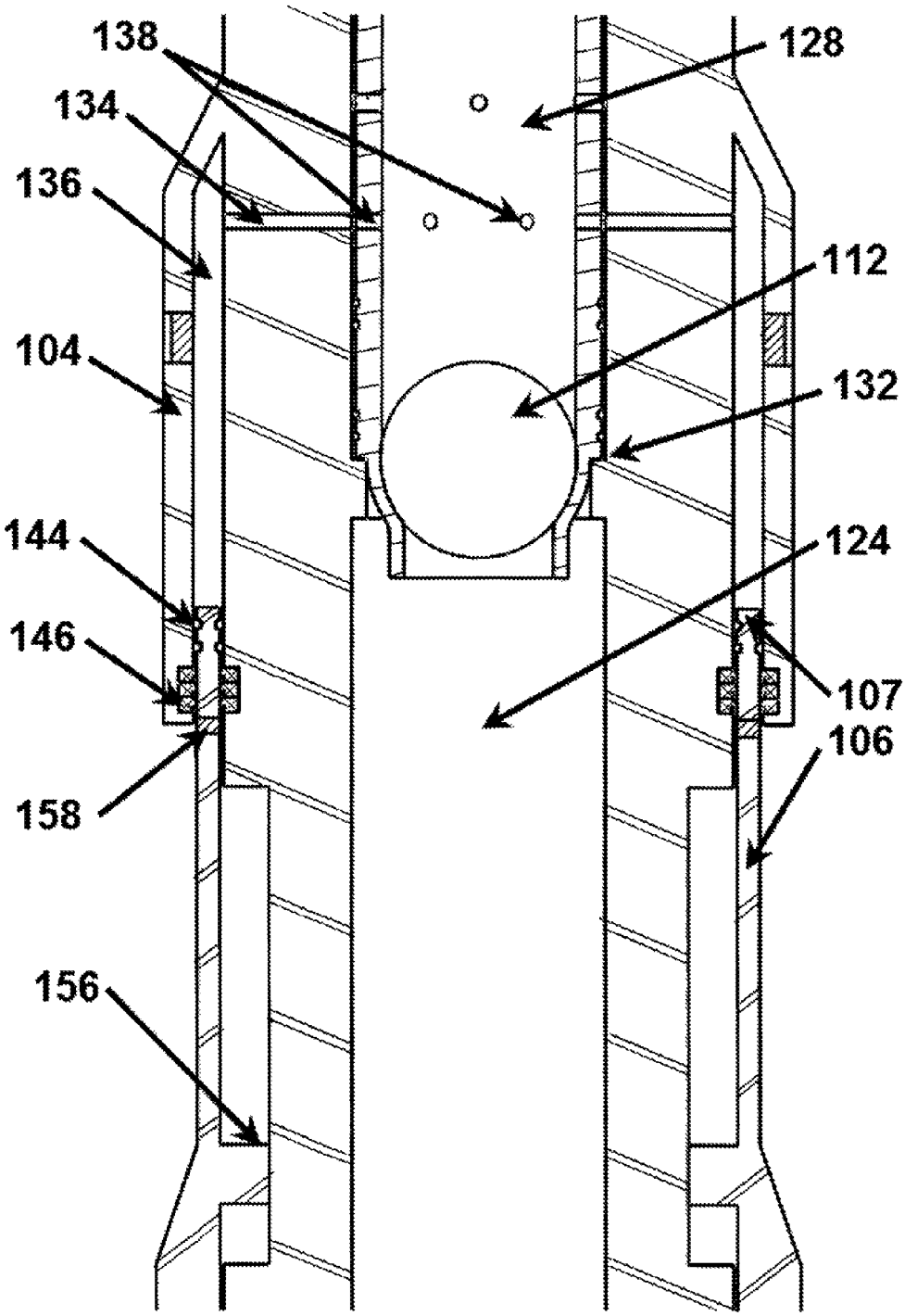

Referring now to FIG. 6A, illustrates the stage of the BOS apparatus operation where the catcher 128 has sheared off the upper shear pin set 114 and translated in the downhole direction until it seats itself on the top of the seat 132 of the control sub section 104. In that position the plurality of catcher ports 138 align with the corresponding plurality of through-flow ports 134 and allow the mud flow, blocked off by the ball 112, to rapidly fill the chamber 136 disposed in a top end area 107 of the slide tube 106. The pressure in the chamber 136 acts on the top ring area 107 of the slider 106 until sufficient force has developed to fail the lower shear pins 158 as shown in FIG. 6B. The failure of the second shear pin set 158 causes the slider cylinder 106 to translate in the downhole direction, without rotation relative to the control sub section 104. The spring 130 keeps the control sub section 104 and the sliding cylinder 106 in contact and helps protect the second set of shear pins 160 from shearing during normal operation of the drillstring (before BOS activation).

Referring now to FIG. 6B, the top most ring 107 of the slotted slider 106 remains sealed between its O rings 144 and annulus seal 146. A person of ordinary skill in the art will also note that the seat of the catcher 128, holding the ball 112, can be designed with enough flexibility such that when desired the system can be over pressurized to force the ball 112 out of the catcher 128. The ball 112 would the be caught in an x-cage, not shown, in a lower section of the BOS apparatus 100.

Figure 7A:
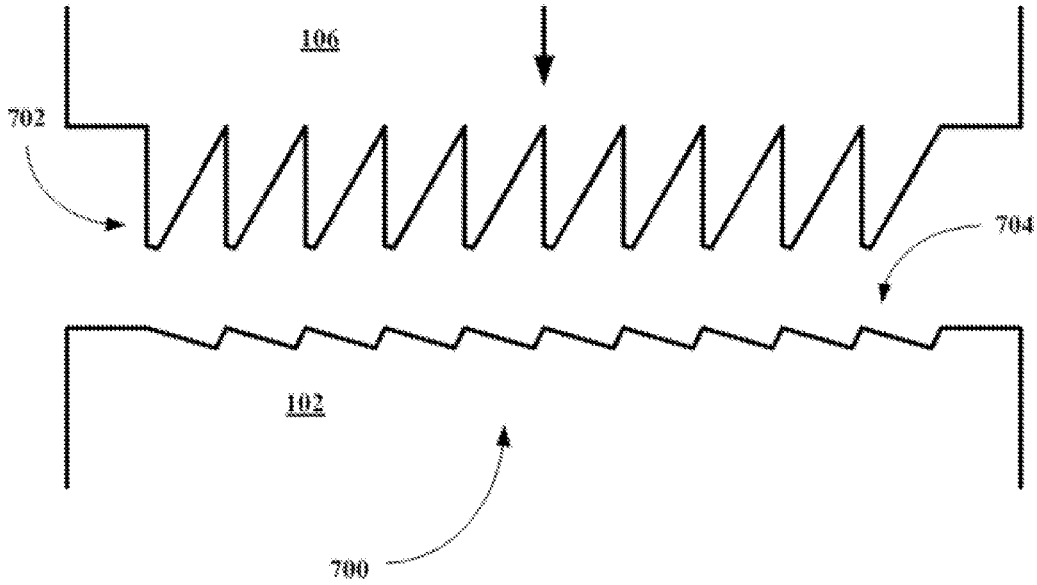
FIGS. 7A&B depict a back-off sub apparatus of this invention that does not include a rotational section, where
Figure 7B:
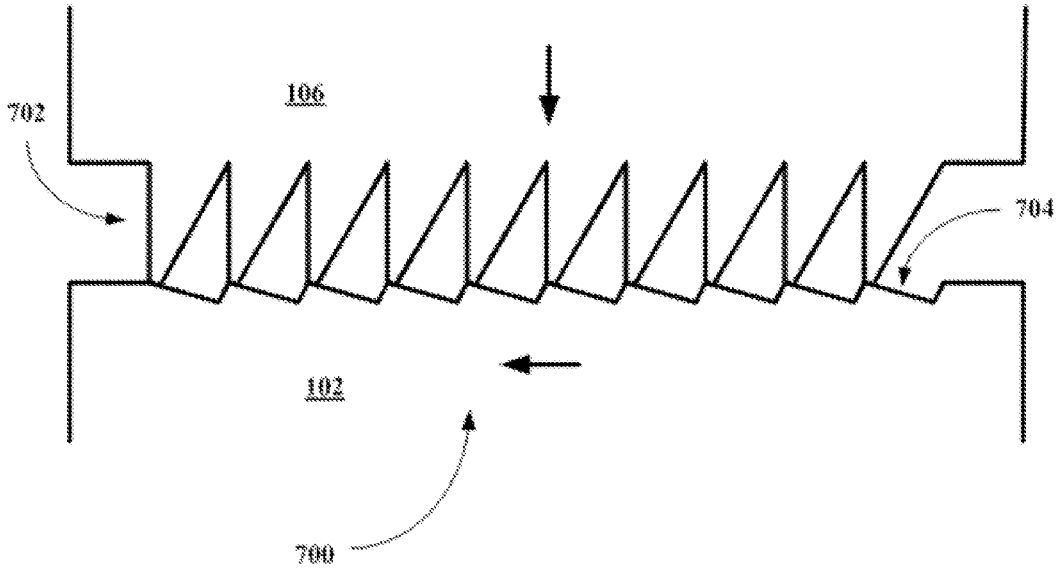

Referring now to FIG. 7, another embodiment of a BOS apparatus, generally 700, is shown that does not includes a rotational section 110. Instead, the translational section 106 ends in a set of large teeth 702 which are designed to engages specially designed teeth 704 disposed on the distal end 122*b* of the abandonment section 102. This embodiment operates with out a rotational section 110, but instead rotational motion is imparted onto the teeth 704 and to the abandonment section 102 to break the connection 108 by the downward translation of the translational section 106.

Figure 8A:
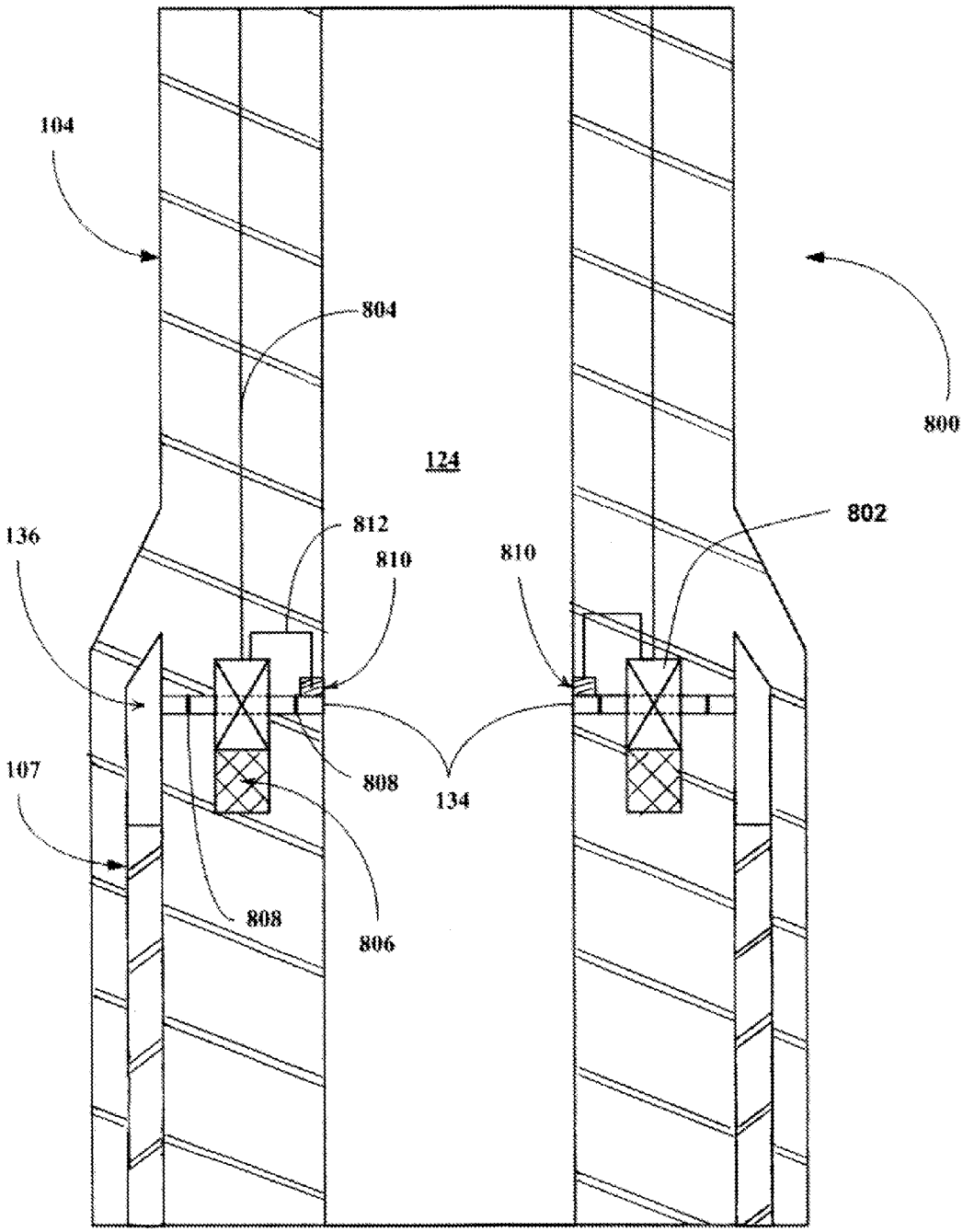
FIGS. 8A&B depict two embodiment of electromechanical activation mechanism of this invention, where the activation mechanism can be used with the translational section of FIG. 7 or the translation and rotational sections of FIG. 1A-6B.

Referring now to FIG. 8A, another embodiment of a BOS apparatus, generally 800, is shown which is a fully electromechanically activated back-off sub design and does not include a ball or catcher held in place with shear pins. The apparatus 800 includes electrically activated valves 802, one for each conduit 134 and designed to open and close fluid flow into the conduits 134. The valves 802 can be in communication with the operator via wires 804 and can be powered by a battery or on-board power supply 806 or can be powered from the surface via the power supply wires not shown. The apparatus 800 can include rupture disks 808 as a guard against valve failure or leakage. The apparatus 800 can also includes pressure sensors 810 that are connected to the valves 802 via sensor wires 812 and are adapted to active the valves 802 when the sensors 810 sense a threshold pressure or sense a set of pre-defined pressure pulses. Once the threshold pressure is sensed or the pulses are sensed, the sensors 810 activate the valves 802 and flow is established between the interior 124 and the chamber 136 through the conduits 134. Of course, if the valves 802 are designed to be activated when the sensors 810 sense the predefined sequence of pulses, the apparatus 800 will not include the rupture disks 808 unless a high pressure pulse is first used to rupture the disks 808 prior to transmitting the pulse sequence. Of course, the valves 802 can be remotely and directly controlled by the operator via the wires 804.

Figure 8B:
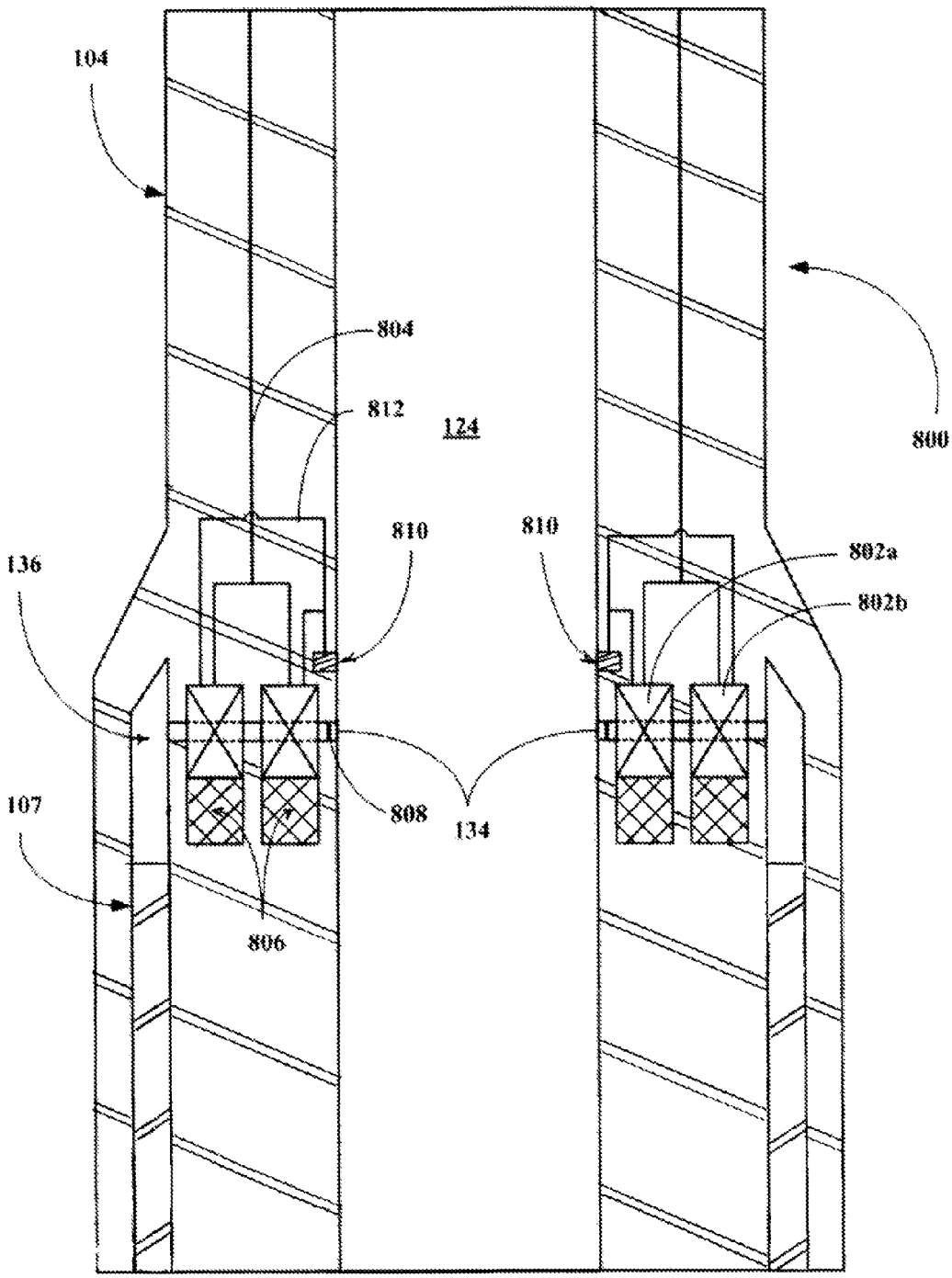

Referring now to FIG. 8B, another embodiment of a BOS apparatus, generally 800, is shown which is a fully electromechanically activated back-off sub design and does not include a ball or catcher held in place with shear pins. The apparatus 800 includes pairs of side-by-side electrically activated valves 802*a*&*b*, one for each conduit 134 and designed to open and close fluid flow into the conduits 134. The valves 802*a*&*b* can be in communication with the operator via wires 804 and can be powered by batteries or on-board power supplies 806 or can be powered from the surface via the power supply wires not shown. The apparatus 800 can include rupture disks 808 as a guard against valve failure or leakage. The apparatus 800 can also includes pressure sensors 810 that are connected to the valves 802 via sensor wires 812 and are adapted to active the valves 802*a*&*b* when the sensors 810 sense a threshold pressure or sense a set of pre-defined pressure pulses. Once the threshold pressure or the pre-defined pulse sequence is sensed, the sensors 810 activates the valves 802*a*&*b* and flow is established between the interior 124 and the chamber 136 through the conduits 134. Of course, if the valve is designed to be activated when the sensors 810 sense the predefined sequence of pulses, the apparatus 800 will not include the rupture disks 808, unless a high pressure pulse is first used to rupture the disks 808 prior to transmitting the pulse sequence. Of course, the valves 802 can be remotely and directly controlled by the operator via the wires 804. The side-by-side valve arrangement permits a greater safeguard against premature or inadvertent activation of the valves 802.

The electromechanical embodiments of this invention can be combined with either the embodiment of FIGS. 1-6 or FIG. 7 to achieve the loosening of the connection 108.

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

Figures 9A, 9B, 9C:
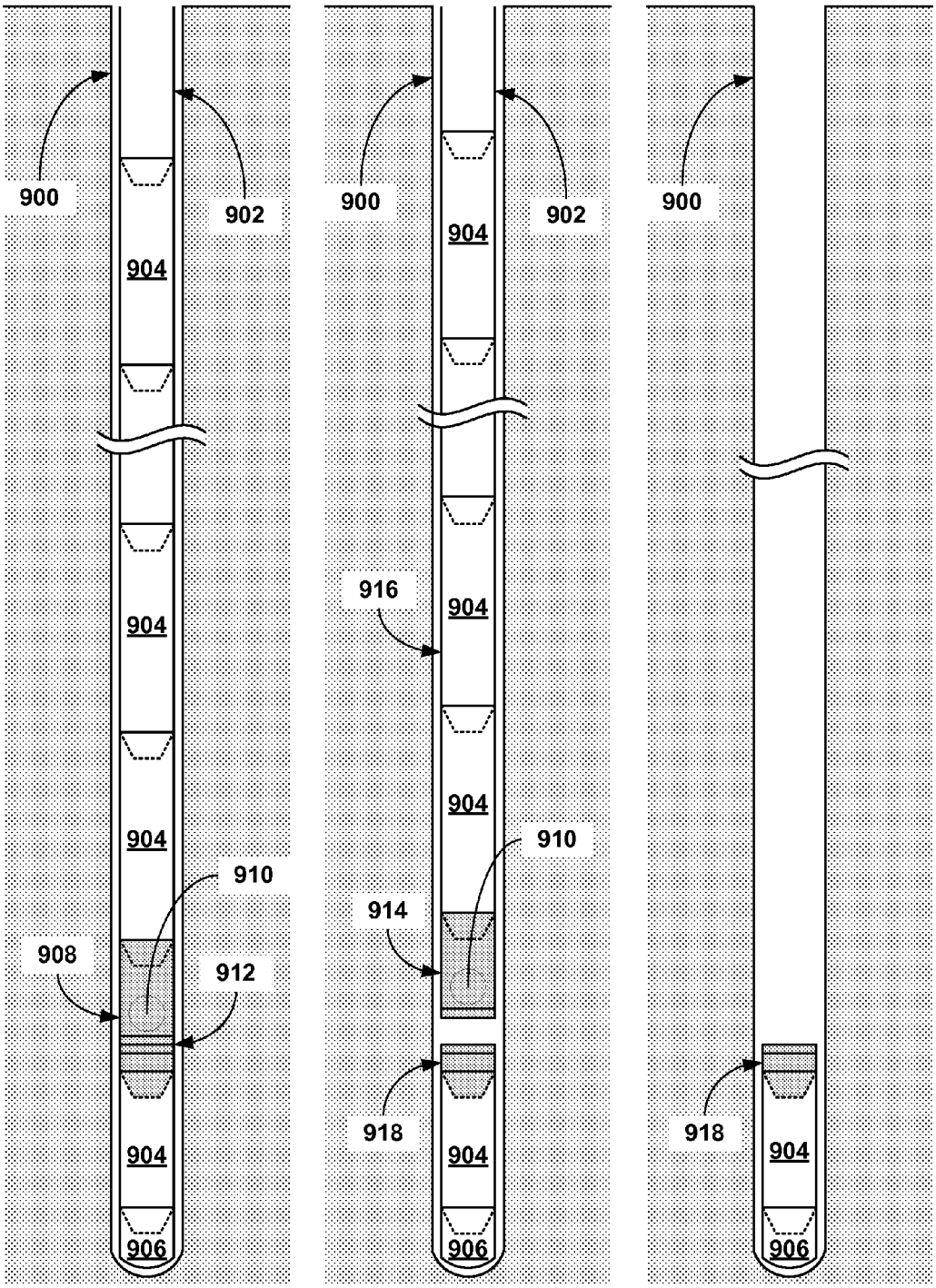
FIGS. 9A-C depict a generalized embodiment of the back-off sub apparatus of this invention in a drill string in a well before, during and after back-off sub disconnection and upper string section and upper back-off portion withdrawn.

Referring now to FIGS. 9A-C, a well 900 is shown including a drill string 902 comprising a plurality of string sections 904, a drill bit section 906, and a BOS apparatus 908. Looking at FIG. 9A, the drill string 902 is shown complete in the well 900 and a ball 910 has been dropped into the string 902 to disconnect the BOS apparatus 908. Looking at FIG. 9B, the BOS apparatus 908 has been disconnected at the BOS connection 912 as described above leaving an upper BOS portion 914 connected to an upper section 916 of the drill string 902 and a lower BOS portion 918 connected to a lower section of the drill string 902 including the drill bit section 906. Looking at FIG. 9B, the upper section 916 of the drill string 902 including the upper BOS portion 912 has been removed from the well 900, while the lower section of the drill string 902 including the drill bit section 906 and the lower BOS portion 916. As stated above, the lower section 918 of the drill string 902 including the drill bit section 906 and the lower BOS portion 918 may be left in the whole or retrieved from the whole using a fishing string.

I claim:

1. A back-off sub apparatus comprising:

an upper portion including:

a control section and a translational section having:

a first sub connector, a first string connector, and a lower portion including:

an abandonment section having:

a second sub connector, and a second string connector, where the upper section and the lower section are connected together via the sub connectors forming a sub connection and where the apparatus is adapted to be placed in a drill string via the string connectors and where the translational section is adapted to move downward rotating the first sub connector relative to the second sub connector and disconnecting the sub connection from the abandonment section and a portion of the string downstream of the abandonment section.

2. The apparatus of claim 1, wherein the connectors are standard API joint connectors.

3. The apparatus of claim 1, wherein the control section comprises:

a catcher including a plurality of ports, a holding means, a stop adapted to stop a downward motion of the catcher in response to an activation pressure, a plurality of conduits, and a hydraulic chamber connected to the plurality of conduits, where the catcher is adapted to catch a ball, the holding means is adapted to hold the catcher in place until the catcher catches the ball and is exposed to the activation pressure and to allow the catcher to move downward in response to the activation pressure, the stop is adapted to align the ports and the conduits, the conduits are adapted to allow fluid to flow into the chamber and the chamber is adapted to fill and push against a top of the translational section causing the translational section to move downward imparting sufficient torque to rotate the first sub connector relative to the second sub connector to overcome a make-up force holding the sub connection tight.

4. The apparatus of claims 1, 2 or 3, further comprising:

a rotatable section mounted in a distal end of the translational section, where the rotatable section is adapted to rotate the first connector relative to the second connector with sufficient rotational and translational force to overcome a make-up force holding the sub connection tight.

5. The apparatus of claim 3, wherein the holding means comprises a shear pin or a plurality of shear pins.

6. The apparatus of claim 3, wherein the activation pressures is a pressure sufficiently above a standard operating pressure to reduce a likelihood of premature activation of the apparatus.

7. The apparatus of claim 3, wherein the holding means comprises:

electro-mechanical valves in the conduits disposed between an interior of the sub and the chamber, where the valves are adapted to open in response to an opening condition permitting fluid to fill the chamber and push on the translational section to overcome a make-up force holding the sub connection tight.

8. The apparatus of claim 7, wherein the opening condition is a command received by the valves from an operator.

9. The apparatus of claim 7, wherein the holding means further comprises:

a pressure sensor or a plurality of pressure sensors, where the opening conditions is when a pre-determined pressure is sensed by the sensor(s) or a series of predefined pressure pulses is sensed by the sensor(s).

10. A method for disconnecting a drill string comprising the steps of:

providing a drill string including one back-off sub or a plurality of back-off subs disposed at a desired location or desired locations along a length of the string, where each sub is capable of independent activation and comprises an apparatus comprising:

an upper portion including:

a control section and a translational section having:

a first sub connector, a first string connector, and a lower portion including:

an abandonment section having:

a second sub connector, and a second string connector, where the upper section and the lower section are connected together via the sub connectors forming a sub connection and where the apparatus is adapted to be placed in the drill string via the string connectors so that the drill string can be disconnected at the sub-connection by rotating the first sub connector relative the second sub connector, leaving the abandonment section and a portion of the string downstream of the abandonment section, lowering the string into a well, activating one of the subs in the string to overcome a make-up force holding the sub connection tight where the translation section is adapted to rotate the first sub connector relative the second sub connector breaking the sub connection, and rotating the string upstream of the sub to disconnect at the sub-connection.

11. The method of claim 10, further comprising the steps of:

tripping the disconnected string including the upper portion of the sub and leaving a string section in the well, where the string section includes the abandonment section of the sub and a portion of the string downstream of the sub.

12. The method of claim 11, further comprising the steps of:

if the string section left in the well is stuck, unsticking the section and retrieving the stuck section.

13. The method of claims 10, 11 or 12, wherein the activating step comprises:

dropping a ball down an interior of the string, where the ball is adapted to be caught by the catcher of the one sub or one of the subs, once the ball is caught, increasing a pressure in the string to an activation pressure, where the activation pressure is sufficient to move the catcher to a stop aligning ports and conduits connected to a chamber, to fill the chamber and push the translational section and to overcome a make-up force holding the sub connection tight.

14. The method of claims 10, 11 or 12, wherein the activating step comprises:

transmitting a command signal to valves of the sub or one of the subs causing the valves of that sub to open conduits of the sub, where the pressure is sufficient to fill a chamber and push the translational section and to overcome a make-up force holding the sub connection tight.

15. The method of claims 10, 11 or 12, wherein the activating step comprises:

transmitting a pressure or a series of pressure pulses down an interior of the string, where the pressure or the series of pressure pulses is sensed by sensors of the sub or one of the subs causing valves of the sub to open conduits, where the pressure is sufficient to fill a chamber and push the translational section and to overcome a make-up force holding the sub connection tight.

16. An apparatus comprising:

a plurality of pipe sections having first and second connectors for forming connections between the pipe sections to form a string of pipes, one sub or a plurality of subs disposed at one or a plurality of desired locations along the string, where each sub comprises:

an upper portion including:

a control section including:

a catcher including a plurality of ports, a holding means, a stop adapted to stop the downward motion of the catcher in response to the activation pressure, a plurality of conduits, and a hydraulic chamber connected to the plurality of conduits, where the catcher is adapted to catch a ball, the holding means is adapted to hold the catcher in place until the catcher catches the ball and is exposed to an activation pressure and to allow the catcher to move downward in response to the activation pressure, the stop is adapted to align the ports and the conduits, the conduits are adapted to allow fluid to flow into the chamber and the chamber is adapted to fill and push against a top of the translational section causing the translational section to move downward with sufficient torque to overcome a make-up force holding the sub connection tight, and a translational section having:

a first sub connector, a first string connector, and a lower portion including:

an abandonment section having:

a second sub connector, and a second string connector, wherein the upper section and the lower section are connected together via the sub connectors forming a sub connection and where the apparatus is adapted to be placed in a drill string via the string connectors so that the drill string can be disconnected at the sub-connection by rotating the first sub connector relative the second sub connector, leaving the abandonment section and a portion of the string downstream of the abandonment section and where the string is capable of being disconnected independently at each sub.

17. The apparatus of claim 16, wherein at least one of the subs is disposed at a location near a drill bit section of the string so that if the string becomes stuck, the string can be disconnected at that sub minimizing the string section left in the well.

18. The apparatus of claim 16, further comprising:

a rotatable section mounted in a distal end of the translational section, where the rotatable section is adapted to rotate the first connector relative to the second connector with sufficient rotational and translational force to overcome a make-up force holding the sub connection tight.

* * * * *